US010686280B2

(12) United States Patent
Chen

(10) Patent No.: US 10,686,280 B2
(45) Date of Patent: Jun. 16, 2020

(54) FLOATING CONNECTOR AND CONNECTING MECHANISM ASSEMBLY

(71) Applicant: P-TWO INDUSTRIES INC., Taoyuan (TW)

(72) Inventor: Pi-Miao Chen, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/272,318

(22) Filed: Feb. 11, 2019

(65) Prior Publication Data

US 2020/0083642 A1 Mar. 12, 2020

(51) Int. Cl.

| | |
|---|---|
| ***H01R 13/631*** | (2006.01) |
| ***H01R 12/71*** | (2011.01) |
| ***H01R 12/70*** | (2011.01) |
| ***H01R 13/502*** | (2006.01) |

(52) U.S. Cl.

CPC ..... *H01R 13/6315* (2013.01); *H01R 12/7005* (2013.01); *H01R 12/716* (2013.01); *H01R 13/502* (2013.01)

(58) Field of Classification Search

CPC ..... H01R 12/91; H01R 13/6315; H01R 13/28

USPC ..... 439/247, 248

See application file for complete search history.

(56) References Cited

U.S. PATENT DOCUMENTS

| | | | | |
|---|---|---|---|---|
| 8,257,095 | B2 * | 9/2012 | Akai | H01R 12/716 439/248 |
| 9,048,601 | B2 * | 6/2015 | Kimura | H01R 24/60 |
| 2006/0276061 | A1 * | 12/2006 | Koguchi | H01R 12/725 439/74 |
| 2009/0239421 | A1 * | 9/2009 | Fukazawa | H01R 12/716 439/660 |
| 2015/0064935 | A1 * | 3/2015 | Funayama | H01R 12/91 439/1 |
| 2015/0270658 | A1 * | 9/2015 | Aoki | H01R 4/48 439/660 |
| 2017/0033480 | A1 * | 2/2017 | Sato | H01R 12/716 |
| 2017/0338592 | A1 * | 11/2017 | Doi | H01R 13/6315 |

* cited by examiner

*Primary Examiner* — Hien D Vu

(74) *Attorney, Agent, or Firm* — Sinorica, LLC

(57) ABSTRACT

The present invention provides a floating connector that includes a connector housing and a connector body. The connector housing has a housing opening, and the housing opening includes a plurality of conductive terminals. The connector body includes a housing member having a plurality of housing member terminal openings, a tongue connector, and a plurality of S-type conductive terminals connecting the housing member and the tongue connector. Wherein, the displacement of the housing member between the tongue connector retrieved by the deformation range of the S-type conductive terminals. When the connector body is connected with the connector housing, the plurality of S-type conductive terminals and the plurality of conductive terminals remain electrically connected in a floating state.

10 Claims, 6 Drawing Sheets

FLOATING CONNECTOR AND CONNECTING MECHANISM ASSEMBLY

FIELD OF THE INVENTION

The present invention is related to the field of connector, particularly, to a floating connector.

BACKGROUND OF THE INVENTION

In the field of cable transmission, a type of insertable-and-extractable electrical connector for conductive terminal can be applied to within the broad scope. Therefore, it is the electronics module essential to the electro-communication filed.

However, conventional connectors are so vulnerable to crash of external force, clamp and entangling that they might be frequently dislocated and incapable of achieving desired connection efficiency. This may cause loose signal transmission as well as abnormal operation of the electric device.

SUMMARY OF THE INVENTION

In order to overcome the above-mentioned problem of conventional techniques, the present invention provides a floating connector which comprises a connector housing and a connector body. The connector housing includes a housing opening, the inside of the housing opening includes a plurality of conductive terminals. A connector body includes a housing member, a plurality of S-type conductive terminals and a tongue connector. Wherein, a housing member is a cyclic case, and the bottom part of the housing member has a plurality of housing member terminal openings; one end of each of the S-type conductive terminals respectively passes through the housing member terminal opening. The tongue connector 30 has a plurality of tongue terminal openings, a tongue opening and a tongue component, the tongue component is disposed inside of the tongue opening and extends from the inside of the tongue connector, a plurality of tongue terminal ports are disposed on the surface of the tongue component. The other end of each of the S-type conductive terminals respectively passes through the tongue terminal opening and is disposed floating through each of the tongue terminal ports, so as to make the housing member remain connected stably with the tongue connector. The housing member is rotationally displaced between the tongue connector retrieved by the deformation range of the plurality of S-type conductive terminals, and when the connector body is connected with the connector housing, the plurality of S-type conductive terminals and each of the plurality of conductive terminals remain electrically connected in a floating state.

Preferably, a clamping projection is positioned on the part in which each of the S-type conductive terminal is disposed floating through the plurality of the tongue terminal ports.

Preferably, a plurality of edge projections are disposed in the inner edge of the tongue opening, when the plurality of S-type conductive terminals are electrically connected with the plurality of conductive terminals, the plurality of edge projections are touched with the outer circumferential edge of the housing opening.

Preferably, the sectional area of the bottom part of the connector housing is bigger than the sectional area of the housing opening, the outer-shell of the connector housing has a housing slant, the housing slant is touched with a tongue opening slant edge of the tongue opening when the connector housing is connected with the connector body.

Preferably, a housing member recessed section is respectively disposed in two sides of top surface of the housing member. A side protrusion is respectively disposed in two sides of the tongue connector. When the housing member is combined with the tongue connector by means of each of the S-type conductive terminals, the side protrusion is accommodated in the housing member recessed section.

Preferably, two housing member slits are disposed in each of the housing member recessed sections, and when the housing member is combined with the tongue connector by means of each of the S-type conductive terminals and the side protrusion is accommodated in the housing member recessed section, two ends of a long U-type metal part are inserted into each of the housing member slits of the housing member recessed section, and a bottom long edge on each of the long U-type metal parts respectively shade each of the side protrusions.

Preferably, a bottom opening is respectively disposed in two sides on bottom part of the housing member, and a short U-type metal part is disposed in each of the bottom openings, and the one end of the short U-type metal part is inserted into the bottom opening, and the other end of the short U-type metal part is attached with side edge of the housing member.

Preferably, the S-type conductive terminal has a first S end and the second S end, the S-type conductive terminal is deformed between 10% to 30% of lateral interval of the first S end and the second S end.

Preferably, the S-type conductive terminal has a first S end, and the first S end further extensively has a first S bottom edge being attached with the lower edge of the tongue connector.

Preferably, the S-type conductive terminal has a second S end, and the second S end is positioned between the tongue connector and the housing member, and the height of the sidewall of the housing member is higher than the height of the second S end.

In view of the above-mentioned objective, the present invention further provides a connecting mechanism assembly which can be applied to provide an electrical device with a floating connection. The connecting mechanism assembly comprises a first connecting device, a second connecting device and a plurality of S-type terminal elements. The first connecting device includes a first connecting projection. The second connecting device includes a second connecting opening being consistent with the first connecting projection, and the second connecting device is connected with the first connecting device through the first connecting projection and the second connecting opening. The plurality of S-type terminal elements are disposed in the first connecting device to connect the first connecting projection with the first connecting device, or are disposed in the second connecting device to connect the second connecting device with the second connecting opening, and when the plurality of S-type terminal elements are disposed in the first connecting device, the second connecting device is connected with the second connecting opening by means of the plurality of electro-conductive terminal elements. When the plurality of S-type terminal elements are disposed in the second connecting device, the first connecting device is connected with the first connecting projection by means of the plurality of electro-conductive terminal element. When the plurality of S-type terminal elements are disposed in the first connecting device, the deformation range of the deformation coming under force is a first deformation range, and when the plurality of S-type terminal elements are disposed in the second connecting device, the deformation range of the deformation coming under force is a second deformation range, and the connecting mechanism assembly maintains the electrical connection of the plurality of S-type terminal elements and the plurality of electro-conductive terminal elements within the first deformation range and the second deformation range.

Preferably, when the first connecting device is connected with the first connecting projection by means of the plurality of S-type terminal elements, a long U-type elements is respectively disposed in two sides of the first connecting device, and each of the long U-type elements respectively shades side edge of the first connecting device and the first connecting projection.

Preferably, when the second connecting device is connected with the second connecting opening by means of the plurality of S-type terminal elements, a long U-type elements is respectively disposed in two sides of the second connecting device, and each of the long U-type elements respectively shades side edge of the second connecting device and the second connecting opening.

The above-mentioned embodiments include hereunder advantages:

(1) By disposing the S-type terminals, the connector housing remain connected with the connector body in a floating state within the range of the deformation coming under force while the connector housing is connected with the connector body.

(2) By further disposing the long U-type metal parts, when the tongue connector come under force beyond the limitation of which the S-type conductive terminal could endure, the long U-type metal part prevents the tongue connector from separating from the housing member, providing the connector with the stable connection for signal transmission.

(3) As for the device of the connecting mechanism assembly by the present invention, even though the device comes under irregular force, it could still maintain the electrical connection of the plurality of S-type terminal and the plurality of conductive terminal within the first deformation range and the second deformation range of the S-type conductive terminal, so as to ensure the device operation.

DETAILED DESCRIPTION OF THE PREFERRED EMBODIMENTS

The following provides a detailed description of the embodiments along with the accompanied drawings to facilitate the understanding of the present invention. It shall be noted that, a person ordinarily skilled in the technique in this field of the present invention application can understand that the details of all units can be not depicted and described in detail for clear illustration and easy understanding in order to prevent repeating and confounding.

Figure 1:
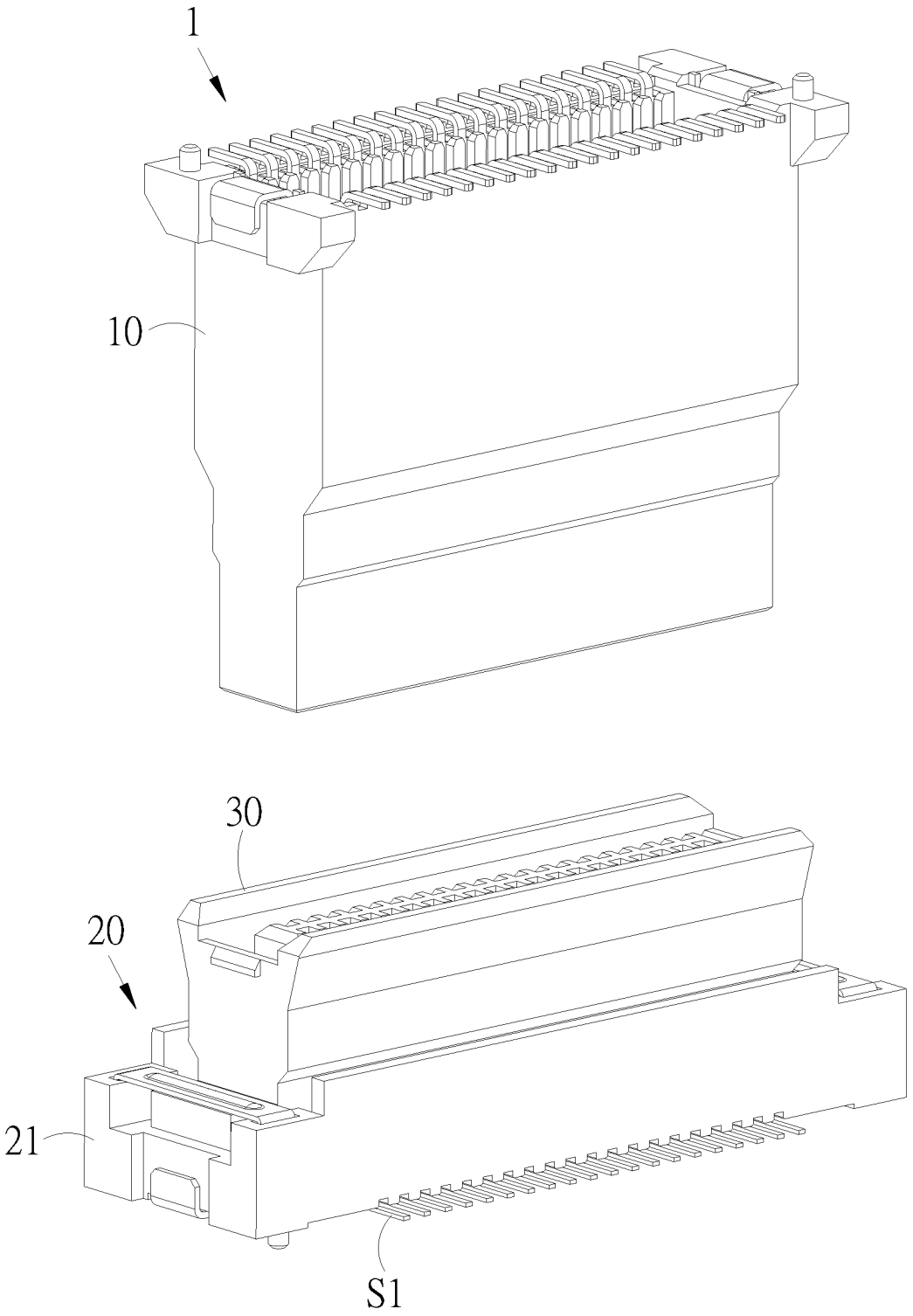
FIG. 1 is an explosion drawing of an embodiment of the present invention.

FIG. 1 is an explosion drawing of an embodiment of the present invention. As shown in the figure, a floating connector 1 provided by the present invention, includes a connector housing 10 and a connector body 20, and further includes a housing member 21, a plurality of S-type conductive terminals S1 and a tongue connector 30 being disposed in the connector body 20.

Figure 2:
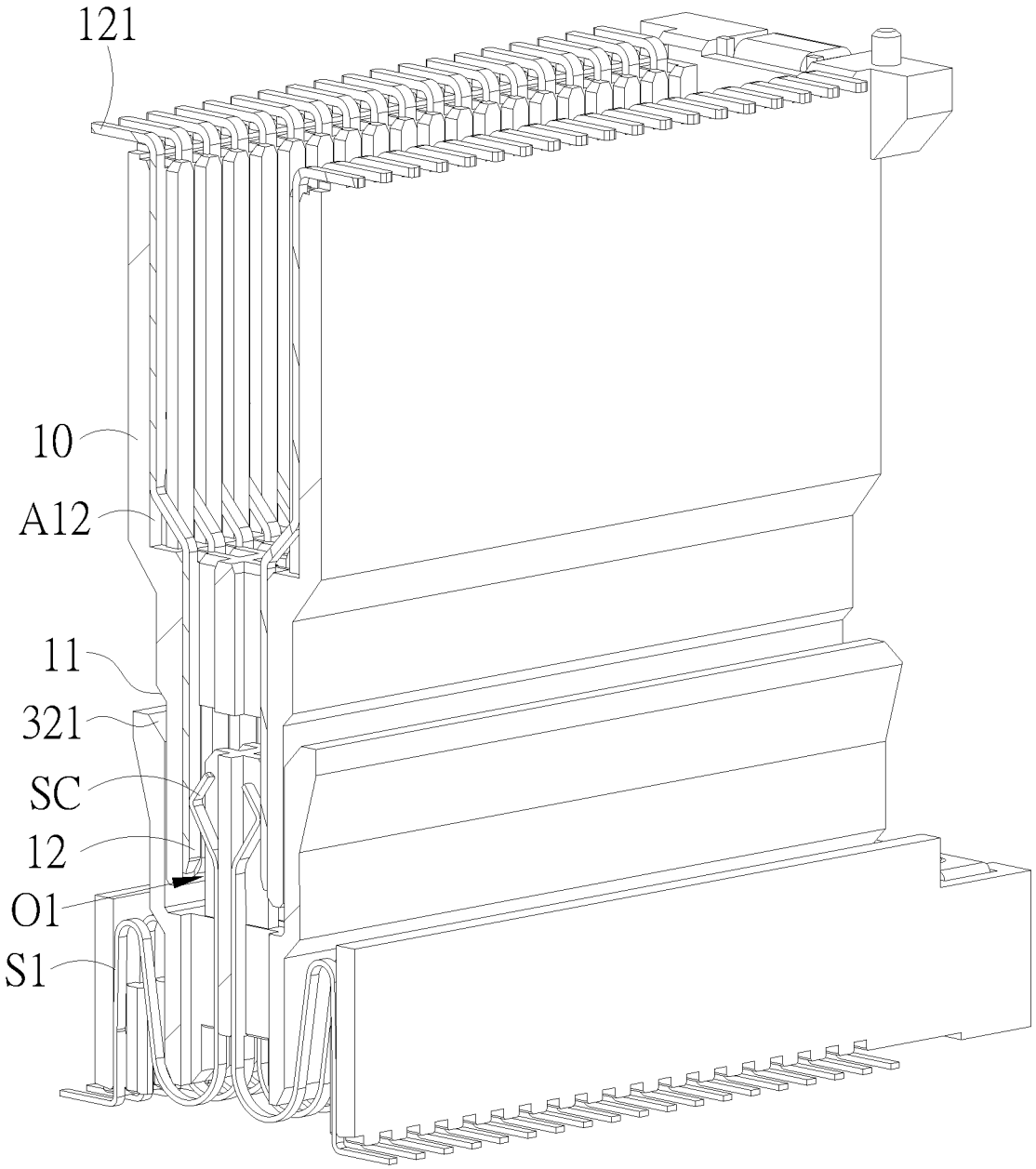
FIG. 2 is a sectional pictorial drawing of the connection between the connector housing and the connector body of an embodiment of the present invention.

FIG. 2 is a sectional drawing of the connector housing of an embodiment of the present invention. As shown in the figure, the connector housing 10 have a housing opening O1, the inside of the housing opening O1 includes a plurality of conductive terminals 12. Each of the conductive terminals 12 are positioned at the bottom part of the connector housing 10 and expose a terminal connecting part 121 which is used for being connected with an electrical device, and a plurality of conductive terminal rails A12 are disposed in the inside of the connector housing 10 in order to accommodate the conductive terminal 12.

In detail, on the embodiment shown in FIG. 2 of the present invention, when the connector housing 10 is the connected with the connector body 20, the tongue connector 30 is accommodated inside of the housing opening O1, the opening part of the connector housing 10 is covered by a tongue opening 32. Wherein, the conductive terminal 12 is touched by a clamping projection SC of the S-type conductive terminal S1 so that the connector housing 10 is electrically connected with the connector body 20.

Wherein, the sectional area of the bottom part of the connector housing 10 is bigger than the sectional area of the housing opening O1, the change in the sectional area of the connector housing 10 forms a housing slant 11 relative to the outer-shelf of the connector housing 10. On some embodiments of the prevent invention, when the connector housing 10 is connected with the connector body 20, the housing slant 11 is disposed touching with a tongue opening slant edge 321 of the inside of the 32 which is exposed outside attributed to the tongue opening 32 expanding its sharp. In other words, under the process that the connector housing 10 and the connector body 20 are approached each other, by disposing the housing slant 11 and the tongue opening slant edge 321, it can prevent the damage to the inner side of the floating connector 1 caused by the shape-deformation of the connector housing 10 and the connector body 20 coming under force.

Wherein, on some embodiments of the prevent invention, the disposition of the housing slant 11 and the tongue opening slant edge 321 is only used as a buffer for the connector housing 10 and the connector body 20 after their connection in order to prevent their shape-deformation coming under force, and is not deemed as a connecting position between the connector housing 10 and the connector body 20 fixed by the housing slant 11 and the tongue opening slant edge 321.

Figure 3:
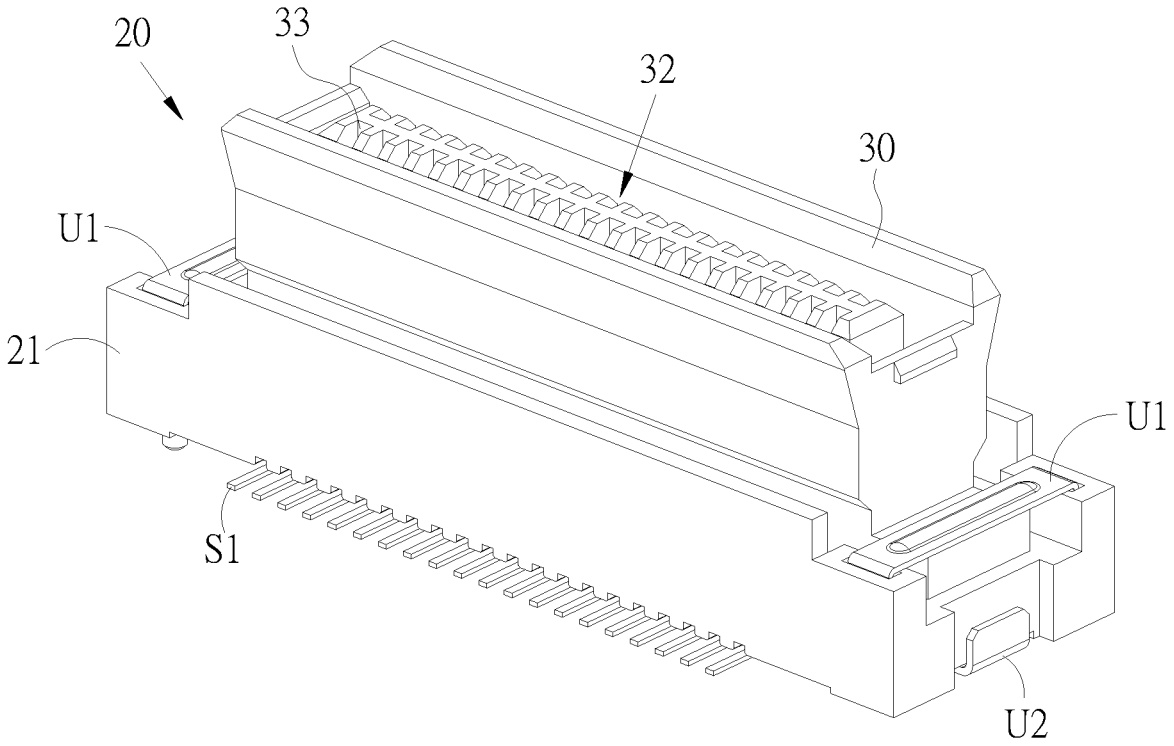
FIG. 3 is a first pictorial drawing of the connector body of an embodiment of the present invention.
Figure 4:
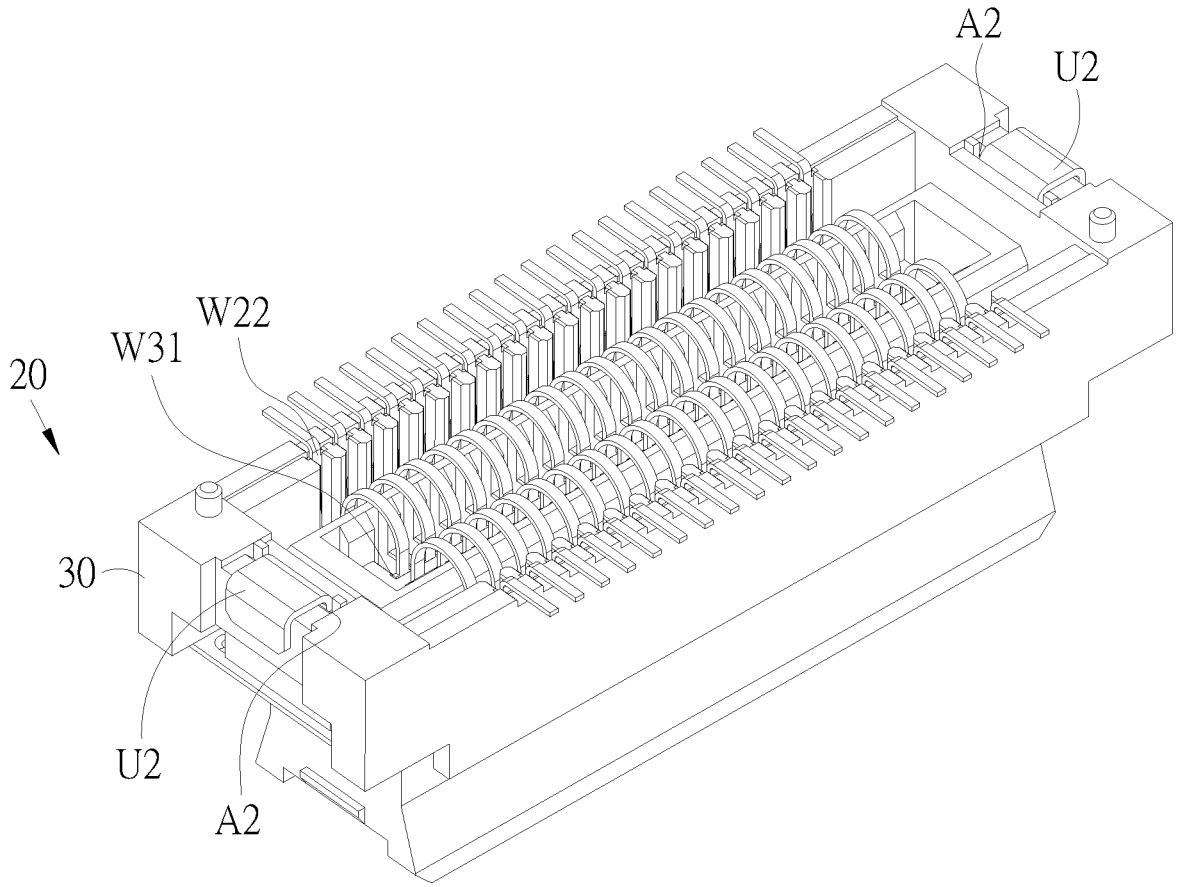
FIG. 4 is a second pictorial drawing of the connector body of an embodiment of the present invention

Continuing, FIG. 3 is a first pictorial drawing of the connector body of an embodiment of the present invention, and FIG. 4 is a second pictorial drawing of the connector body of an embodiment of the present invention. As shown in the figures, the connector body 20 includes the housing member 21, the plurality of S-type conductive terminals S1, and the tongue connector 30. Wherein, the housing member 21 is a cyclic case, the bottom part of the housing member 21 has a plurality of housing member terminal openings W22.

Further Referring to FIG. 4, wherein, two bottom openings A2 are respectively disposed in the two sides on the bottom part of the housing member 21, and a short U-type metal part U2 is disposed in each of the bottom openings A2, and the one end of the short U-type metal part U2 is inserted into the bottom opening A2, and the other end of the short U-type metal part U2 is attached with the edge of the housing member 21.

Wherein, one side of the plurality of S-type conductive terminals S1 respectively passes through one housing member terminal opening W22. The tongue connector 30 has a plurality of tongue terminal openings W31, the tongue opening 32 and a tongue component 33, the tongue component 33 is disposed inside of the tongue opening 32 and extends from the inside of the tongue connector 30 toward the tongue opening 32.

Figure 5:
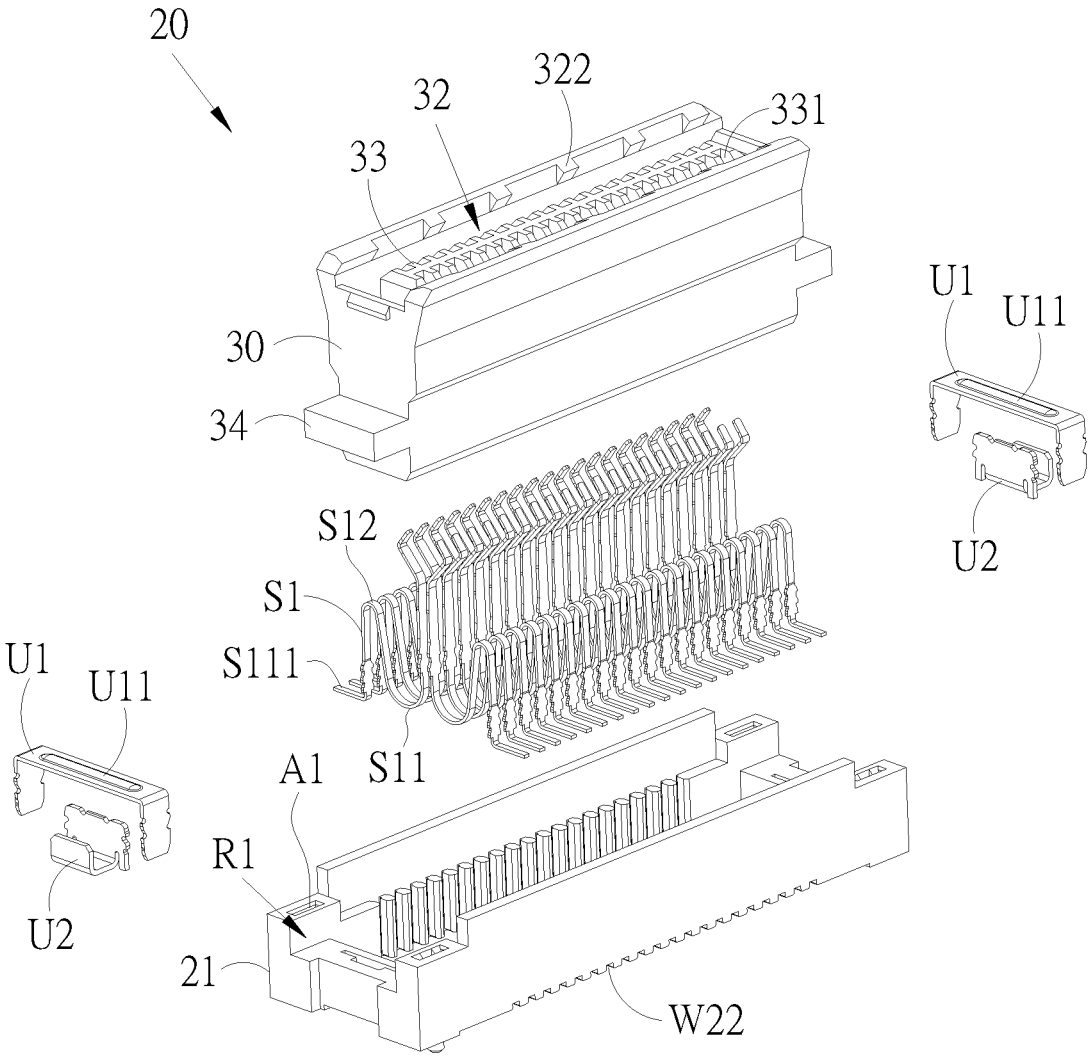
FIG. 5 is an explosion drawing of the connector body of an embodiment of the present invention.

FIG. 5 is an explosion drawing of the connector body of an embodiment of the present invention. As shown in the figure, the surface of the tongue component 33 has a plurality of tongue terminal ports 331, the other side of each S-type conductive terminals S1 respectively passes through one tongue terminal opening W31 and is disposed floating through each of the tongue terminal ports 331. By disposing the S-type conductive terminal S1, the housing member 21 is connected stably with the tongue connector 30.

Furthermore, the housing member 21 is rotationally displaced between the tongue connector 30 retrieved by the deformation range of the plurality of S-type conductive terminals S1, and when the connector body 20 is connected with the connector housing 10, each of the S-type conductive terminals S1 and each of the plurality of conductive terminals 12 remain electrically connected in a floating state.

On some embodiments of the prevent invention, the connector housing 10 are electrically connected with the connector body 20 when a portion of S-type conductive terminals S1 which are disposed floating through each of the tongue terminal ports 331 are touched with the conductive terminal 12. Wherein, the S-type conductive terminal S1 has the clamping projection SC in order to further provide the S-type conductive terminal S1 and the conductive terminal 12 with the clamp force which remains the S-type conductive terminal S1 electrically connected with the conductive terminal 12 more firmly.

In further detail, on some embodiments of the prevent invention, a plurality of edge projections 322 can be disposed in the inner edge of the tongue opening 32, when the connector housing 10 is inserted into the connector body 20, the plurality of edge projections 322 being disposed in the inner edge of the tongue opening 32 are touched with the outer circumferential edge of the housing opening O1. By increasing the frictional force between the tongue opening 32 and the housing opening O1, it makes the tongue opening 32 being clamped with the housing opening O1 more firmly. Wherein, on some embodiments of the prevent invention, the edge projection 322, for example, can be disposed perpendicular to the housing opening O1 in a strip state, or distributed in punctate or forming dotted-line stripes in order to further increase the frictional force between the tongue opening 32 and the housing opening O1.

Furthermore, two housing member recessed sections R1 are respectively disposed in two sides of the top surface of the housing member 21, and the two side protrusions 34 are respectively disposed in two sides of the tongue connector 30. When the housing member 21 is combined with the tongue connector 30 by means of each of the S-type conductive terminals S1, the side protrusion 34 is accommodated in the housing member recessed section R1.

Wherein, two housing member slits A1 are disposed in each of the housing member recessed sections R1, and when the housing member 21 is combined with the tongue connector 30 by means of each of the S-type conductive terminals S1 and the side protrusion 34 is accommodated in the housing member recessed section R1, two ends of a long U-type metal part U1 is fixed on the housing member recessed section R1 because each of the housing member slits A1 of the same housing member recessed section R1, and a bottom long edge U11 on each of the long U-type metal parts U1 respectively shade each of the side protrusions 34.

Referring to the housing member 21 again, two bottom openings A2 are respectively disposed in the two sides on the bottom part of the housing member 21, and the short U-type metal part U2 is disposed in each of the bottom openings A2, one end of the short U-type metal part U2 is inserted into the bottom opening A2, and the other end of the short U-type metal part U2 is attached with the side edge of the housing member 21. This forms a type of electro-conductive casing on the housing member 21 matching with the long U-type metal part U1.

Wherein, on some embodiments of the prevent invention, the S-type conductive terminal S1 has a first S end S11, and also has a first S bottom edge S111 which is attached with the lower edge of the tongue connector 30.

Furthermore, the S-type conductive terminal S1 has a second S end S12, the second S end S12 is positioned between the tongue connector 30 and the housing member 21, and the height of the sidewall of the housing member 21 is higher than the height of the second S end S12.

Figure 6:
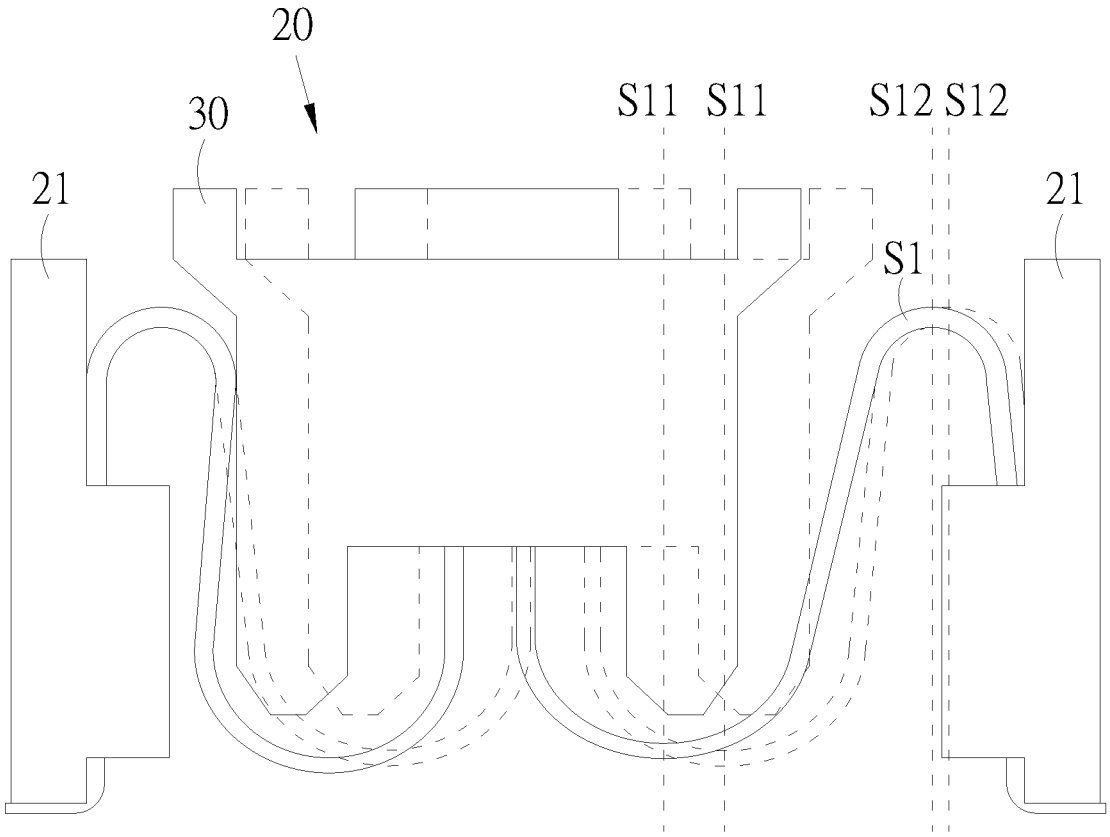
FIG. 6 is a drawing of the deformation of the S-type terminal of an embodiment of the present invention.

FIG. 6 is a drawing of the deformation of the S-type terminal of an embodiment of the present invention. The S-type conductive terminal S1 is accommodated between the housing member 21 and the tongue connector 30, and the S-type conductive terminal S1 is deformed between 10% to 30% of a lateral interval of the first S end S11 and the second S end S12. However, the embodiment of the present invention will not be limited to this, and the deformation range of the S-type terminal may influenced by its material. The S-type terminal can be disposed to deform in a vertical interval, for example, being deformed between 10% to 30% of a vertical interval of the first S end S11 and the second S end S12.

The present invention further reveals a connecting mechanism assembly which can be applied to provide an electrical device with a floating connection. The connecting mechanism assembly comprises a first connecting device, a second connecting device, and a plurality of S-type terminal elements, wherein, the first connecting device includes a first connecting projection, and the second connecting device includes a second connecting opening being consistent with the first connecting projection, the second connecting device is connected with the first connecting device by through the first connecting projection and the second connecting opening.

Wherein, the plurality of S-type terminal elements are disposed in the first connecting device to connect the first connecting projection with the first connecting device, or are disposed in the second connecting device to connect the second connecting device with the second connecting opening. When the plurality of S-type terminal elements are disposed in the first connecting device, the second connecting device is connected with the second connecting opening by means of an electro-conductive terminal elements.

When the plurality of S-type terminal elements are disposed in the first connecting device, the second connecting opening is disposed in the second connecting device, and the plurality of electro-conductive terminal elements are disposed in the second connecting opening. When the plurality of S-type terminal elements are disposed in the second connecting device, the first connecting projection is disposed in the first connecting device, and the plurality of electro-conductive terminal elements are disposed in the first connecting projection.

When the plurality of S-type terminal elements are disposed in the first connecting device, the deformation range of the deformation coming under force is defined as a first deformation range, and when the plurality of S-type terminal elements are disposed in the second connecting device, the deformation range of the deformation coming under force is defined as a second deformation range. By disposing the plurality of S-type terminal elements, the connecting mechanism assembly of the present invention maintain the electrical connection of the plurality of S-type terminal elements and the plurality of electro-conductive terminal elements within the first deformation range and the second deformation range.

Wherein, the first deformation range and the second deformation range can be changed relative to the connection method of the first connecting device with the second connecting device and applying field thereof. For example, it can be controlled between 10% to 30% of a literal interval and a vertical interval of the first S end and the second S end at the S-type terminal element.

By disposing the connecting mechanism assembly of the present invention, the devices installing the connecting mechanism assembly may include, for example, an automotive device. Even though such car electric devices are suffered with irregular vibration when the car is going through rough road, the operation performance of the device will be maintained owing to the electrical connection of the plurality of S-type terminal elements and the plurality of electro-conductive terminal elements, within the first deformation range and the second deformation range of the connecting mechanism assembly. Therefore, the operation of the device will not be influenced by irregular force of the connecting mechanism assembly as well, or be able to reduce the influence on the connecting mechanism assembly's performance by irregular force. Furthermore, the connecting mechanism assembly of the present invention could be applied not only to automotive devices but also to the other devices which may come under force of irregular directions or scales, in order to ensure a variety of devices to maintain their electrical connection.

On some embodiments which introduce that the first connecting device is connected with the first connecting projection by means of the plurality of S-type terminal elements, two long U-type elements can be respectively disposed in two sides of the first connecting device, and each of the long U-type elements respectively shades the side edge of the first connecting device and the first connecting projection. By disposing the long U-type element, when the plurality of S-type terminal elements are deformed coming under force to influence the connection between the first connecting device and the first connecting projection, the long U-type element further firms the connection of the long U-type element with the first connecting projection on the first connecting device, so as to be moved within the range of which the long U-type element shades the first connecting projection, and further prevents the first connecting projection from separating from the first connecting device.

Otherwise, on some embodiments which introduce that the second connecting device is connected with the second connecting opening by means of the plurality of S-type terminal elements, two long U-type elements can be respectively disposed in two sides of the second connecting device, and each of the long U-type elements respectively shades the side edge of the second connecting device and the second connecting opening. By disposing the long U-type element, when the plurality of S-type terminal elements is deformed coming under force to influence the connection between the second connecting device and the second connecting opening, the long U-type element further firms the connection of the long U-type element with the second connecting opening on the second connecting device, so as to be moved within the range of which the long U-type element shades the second connecting opening, and further prevents the second connecting opening from separating from the second connecting device.

In conclusion, by disposing the S-type conductive terminals of the present invention, the connector housing remain connected with the connector body in a floating state, within the range of the deformation coming under force while the connector housing is connected with the connector body. In addition, by further disposing the long U-type metal parts, when the tongue connector come under force beyond the limitation of which the S-type conductive terminal could endure, the long U-type metal part prevents the tongue connector from separating from the housing member, providing the connector with the stable connection for signal transmission.

Otherwise, as for the device of the connecting mechanism assembly by the present invention, even though the device comes under irregular force, it could still maintain the electrical connection of the plurality of S-type terminal and the plurality of conductive terminal within the first deformation range and the second deformation range of the S-type conductive terminal, so as to ensure the device operation.

The embodiments described above are merely illustrative, and the invention cannot be limited thereto. The scope of the patent, that is, the equivalent variations or modifications made by the present invention in the spirit of the invention, should still be included in the scope of the invention.

What is claimed is:

1. A floating connector, comprising:

a connector housing with a housing opening, and an inside of the housing opening includes a plurality of conductive terminals;

a connector body, including:

a housing member being in a form of a cyclic case, and the bottom part of the housing member has a plurality of housing member terminal openings;

a plurality of S-type conductive terminals, one end of each of the S-type conductive terminals respectively passes through the housing member terminal opening;

a tongue connector with a plurality of tongue terminal openings, a tongue opening and a tongue component, the tongue component is disposed inside of the tongue opening and extends from an inside of the tongue connector, a plurality of tongue terminal ports are disposed on the surface of the tongue component, the other end of each of the S-type conductive terminals respectively passes through the one tongue terminal opening and is disposed floating through each of the tongue terminal ports, so as to make the housing member remain connected stably with the tongue connector;

wherein, the housing member is rotationally displaced between the tongue connector retrieved by a deformation range of the plurality of S-type conductive terminals, and when the connector body is connected with the connector housing, each of the S-type conductive terminals and each of the plurality of conductive terminals remain electrically connected in a floating state;

wherein an outer-shell of the connector housing has a housing slant, the housing slant is touched with a tongue opening slant edge of the tongue opening when the connector housing is connected with the connector body;

wherein a housing member recessed section is respectively disposed in two sides of top surface of the housing member; and a side protrusion is respectively disposed in two sides of the tongue connector; wherein, when the housing member is combined with the tongue connector by means of each of the S-type conductive terminals, the side protrusion is accommodated in the housing member recessed section; and wherein two housing member slits are disposed in each of the housing member recessed sections, and when the housing member is combined with the tongue connector by means of each of the S-type conductive terminals and the side protrusion is accommodated in the housing member recessed section, two ends of a long U-type metal part are inserted into each of the housing member slits of the same housing member recessed section, and a bottom long edge formed on each of the long U-type metal parts that respectively shading each of the side protrusions.

2. The floating connector according to claim 1, wherein a clamping projection is positioned on a part in which each of the S-type conductive terminal is floatingly disposed through the plurality of the tongue terminal ports.

3. The floating connector according to claim 1, wherein a plurality of edge projections are disposed in an inner edge of the tongue opening, when the plurality of S-type conductive terminals are electrically connected with the plurality of conductive terminals, the plurality of edge projections are touched with an outer circumferential edge of the housing opening.

4. The floating connector according to claim 1, wherein a bottom opening is respectively disposed in two sides on bottom part of the housing member, and a short U-type metal part is disposed in each of the bottom openings, and the one end of the short U-type metal part is inserted into the bottom opening, and the other end of the short U-type metal part is attached with side edge of the housing member.

5. The floating connector according to claim 1, wherein the S-type conductive terminal has a first S end and a second S end, the S-type conductive terminal is deformed between 10% to 30% of lateral interval of the first S end and the second S end.

6. The floating connector according to claim 1, wherein the S-type conductive terminal has a first S end, and the first S end extensively has a first S bottom edge being attached with the lower edge of the tongue connector.

7. The floating connector according to claim 1, wherein the S-type conductive terminal has a second S end, and a second S end is positioned between the tongue connector and the housing member, and a height of a sidewall of the housing member is higher than the height of the second S end.

8. A connecting mechanism assembly applied to provide an electrical device with a floating connection, comprising:

a first connecting device, including a connector housing having a first connecting projection with an opening therein;

a second connecting device, including a connector body having a housing member with a second connecting opening being consistent with the first connecting projection, and the second connecting device is connected with the first connecting device through the first connecting projection and the second connecting opening;

a plurality of S-type terminal elements, being disposed in the first connecting device to connect the first connecting projection with the first connecting device, or being disposed in the second connecting device to connect the second connecting device with the second connecting opening, when the plurality of S-type terminal elements are disposed in the first connecting device, the second connecting opening is disposed in the second connecting device, and the plurality of electro-conductive terminal elements are disposed in the second connecting opening; when the plurality of S-type terminal elements are disposed in the first connecting device, the second connecting opening is disposed in the second connecting device, and the plurality of electro-conductive terminal elements are disposed in the second connecting opening; when the plurality of S-type terminal elements are disposed in the second connecting device, the first connecting projection is disposed in the first connecting device, and the plurality of electro-conductive terminal elements are disposed in the first connecting projection;

wherein, when the plurality of S-type terminal elements are disposed in the first connecting device, a deformation range of the deformation coming under force is a first deformation range, and when the plurality of S-type terminal elements are disposed in the second connecting device, the deformation range of the deformation coming under force is a second deformation range, and the connecting mechanism assembly maintains the electrical connection of the plurality of S-type terminal elements and the plurality of electro-conductive terminal elements within the first deformation range and the second deformation range;

wherein an outer-shell of the connector housing has a housing slant, the housing slant is touched with a tongue opening of slant edge of a tongue connector when the connector housing is connected with the connector body;

wherein the housing member recessed section is respectively disposed in two sides of top surface of the housing member; and a side protrusion is respectively disposed in two sides of the tongue connector; wherein, when the housing member is combined with the tongue connector by means of each of the S-type conductive terminals, the side protrusion is accommodated in the housing member recessed section.

9. The connecting mechanism assembly according to claim 8, wherein when the first connecting device is connected with the first connecting projection by means of the plurality of S-type terminal elements, a long U-type elements is respectively disposed in two sides of the first connecting device, and each of the long U-type elements respectively shades side edge of the first connecting device and the first connecting projection.

10. The connecting mechanism assembly according to claim 8, wherein when the second connecting device is connected with the second connecting opening by means of the plurality of S-type terminal elements, a long U-type elements is respectively disposed in two sides of the second connecting device, and each of the long U-type elements respectively shades side edge of the second connecting device and the second connecting opening.

* * * * *